US008400240B2

(12) United States Patent
Pfeiffer et al.

(10) Patent No.: US 8,400,240 B2
(45) Date of Patent: Mar. 19, 2013

(54) MAGNETIC SWITCHING DEVICE

(75) Inventors: Klaus Pfeiffer, Heidenheim (DE); Ulrich Konzelmann, Stuttgart (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 314 days.

(21) Appl. No.: 12/530,849

(22) PCT Filed: Feb. 20, 2008

(86) PCT No.: PCT/EP2008/001304

§ 371 (c)(1), (2), (4) Date: Dec. 29, 2009

(87) PCT Pub. No.: WO2008/113448

PCT Pub. Date: Sep. 25, 2008

(65) Prior Publication Data

US 2011/0128102 A1 Jun. 2, 2011

(30) Foreign Application Priority Data

Mar. 16, 2007 (DE) ..... 10 2007 013 292

(51) Int. Cl.

| | |
|---|---|
| ***H01H 9/00*** | (2006.01) |
| ***H01H 3/48*** | (2006.01) |
| ***H01H 5/02*** | (2006.01) |

(52) U.S. Cl. ..... 335/205; 335/207; 200/342; 200/404

(58) Field of Classification Search ..... 335/205–207; 200/342, 404

See application file for complete search history.

(56) References Cited

U.S. PATENT DOCUMENTS

| | | | | |
|---|---|---|---|---|
| 2,600,581 A | | 6/1952 | Schenendorf | |
| 2,814,697 A | * | 11/1957 | Hutt | 200/533 |
| 5,887,446 A | | 3/1999 | Lee | |

FOREIGN PATENT DOCUMENTS

DE 34 09 286 A1 9/1985

* cited by examiner

*Primary Examiner* — Ramon Barrera
(74) *Attorney, Agent, or Firm* — GrayRobinson, P.A.

(57) ABSTRACT

A magnetic switching device is provided with a first switching device which is provided with a movable magnet connected to a contact bridge, and with a second switching device which is provided with a magnet connected to a movable switch element. The magnets have the same polarity on the front faces facing each other. Positioned between the magnets is a separating plate made of ferromagnetic material, which is smaller than the front faces of the magnets which face each other.

21 Claims, 6 Drawing Sheets

MAGNETIC SWITCHING DEVICE

CROSS REFERENCE TO RELATED APPLICATIONS

This is a U.S. National Phase Entry under 35 U.S.C. §371 of, and claims priority under 35 U.S.C. Sections 119(a)-d), 120, 363 and 365 to, International Application No. PCT/EP2008/001304, filed Feb. 20, 2008 which designated the United States and at least one other country in addition to the United States and claimed priority to German Application No. 10 2007 013 292.3, filed Mar. 16, 2007. The specifications of these applications are hereby expressly incorporated by reference in their entirety to form a part of this application.

FIELD OF THE INVENTION

The invention relates to a magnetic switching apparatus having a first switching device, which is provided with a movable magnet connected to a contact bridge, and having a second switching device, which is provided with a magnet which is connected to a movable switching element. The invention also relates to a magnetic switching apparatus for producing an electrical connection between a first movable or fixed element and a second movable or fixed element, in particular a vehicle door and a vehicle frame.

BACKGROUND OF THE INVENTION

In particular in the construction of vehicles, it is necessary to set a specific switched state between the vehicle or the vehicle frame and a movable component of the vehicle such as, for example, a door, a tailgate, a trunk lid or an engine hood. In this context, switching processes are also to be carried out reliably or else status signal displays are to be given reliably. Therefore, for example when a door, a tailgate or a trunk lid is opened, a light is to be switched on which reliably goes out again after the door, the tailgate or the trunk lid closes. In a similar way, a status signal is also to be produced in the manner of a sensor which indicates the position of the movable component with respect to the vehicle, such as, for example the display of an open door on the driver's dashboard.

The known electrical switching apparatuses and status display apparatuses are frequently composed of a microswitch which, when the movable component opens and closes, responds and at the same time also produces or disconnects an electrical connection. In a function as a status display, the apparatus signals an open door, for example.

However, a disadvantage for satisfactory functioning of the known switching apparatuses is that the movable components are usually elastically connected to the vehicle by means of seals. This means that in the driving state relative movements can occur between the movable component and the vehicle, and vibrations may also be produced. If these relative movements or vibrations are very strong, the switching apparatus or status display apparatus may respond despite a closed position and display a supposed change in state such as, for example, through flickering of the internal light or of the display of the door which is supposedly open. This risk occurs, in particular, in the case of sliding doors of vehicles in which two different movement sequences occur, specifically a sliding process in a first step and subsequently a swiveling-in process while the door is still swiveled out in the rear region, in which case a slight sliding movement of the door still occurs during the last swiveling-in process. The switching device is intended to respond only after this.

If an excessively large amount of play occurs within the range of the last sliding process, which can amount to several millimeters, owing to vibrations or even tolerances in the driving operation, it is possible, for example, for the switching apparatus to respond incorrectly.

SUMMARY OF THE INVENTION

The present invention is therefore based on the object of providing an apparatus of the type mentioned at the beginning with which a reliable switching process is carried out starting from a specific switched state, but the desired switched state, for example an electrical connection or a display, is maintained even if vibrations or relative movements occur between individual elements.

According to the invention, this object is achieved in a first implementation by means of the features specified in claim 1.

According to the invention, the assignment of the switching device components and the formation of contact with them is selected in such a way that different switching-on and switching-off points are produced in such a way that, after a first magnetic switched state has been produced, the second switched state, for example opening of the switching device components, or moving of said switching device components away from one another, only occurs at a later time or that the two switching device components are separated from one another again only after relatively large displacements. A type of hysteresis virtually occurs between the switching-on point and the switching-off point.

In other words, the first switched state occurs in a substantially precise and defined fashion in a specific position as a result of a corresponding movement of the movable switching element, while the second switched state does not occur until after a movement play, preset as desired, of the two switching devices relative to one another.

As a result of this embodiment it is possible, for example, to maintain for longer electrical contact or a displayed state in the case of relative movements or vibrations between the elements whose state is to be controlled, for example between a door and a vehicle frame, with the result that unintentional switching states do not occur, as is the case in the prior art.

This method of making contact is user-defined and is tailored to the respective application case. It is therefore possible, for example, for the first precise switched state to occur as a result of opening of contacts due to removal of the contact bridge, which produces the contact connection, from a contact element, and a second switched state, in this case closing of the contacts, to occur only after a predefined amount of play has been overcome. Of course, switching in an inverted order is also possible here with precise closing of the contacts and "delayed" opening of the contacts.

In order to set the amount of play it is possible, according to the invention, to adjust the distance between the movable magnet connected to the contact bridge and the separating plate. This can be done, for example, by changing the position of the magnet or magnets with respect to one another and/or the position of the separating plate.

A further advantage of the invention over the prior art is that the magnetic switching apparatus can be arranged, together with the two switching devices, in a housing from which just the switching element then projects.

As a result of this embodiment, premounting can be carried out for the entire switching apparatus, in which case it is ultimately only then necessary to assign the switching element to a driver element which activates it.

According to the invention, the switching element can be embodied, for example, as a switching tappet.

The separating plate made of ferromagnetic or magnetic material, for example a soft iron plate, can be of any desired shape and its shape is tailored according to the respective application switching point. All that is important is that it is smaller than the end faces, facing one another, of the magnets.

The core of the invention is based on this embodiment and the shape of the separating plate in relation to the magnets. If the separating plate were of the same size or larger than the end faces, facing one another, of the magnets, the repulsion forces could not work due to the same polarity. For this purpose, the separating plate must be made at least slightly smaller so that the magnetic field lines can correspondingly act past the separating plate toward the respective other magnet.

The size and shape of the separating plate is tailored here according to the respective application case. For example, in the case of magnets with circular end faces and a circular or rectangular separating plate arranged in the center with free circular segments of equal sizes on both sides for the magnetic field lines to pass through, there would be symmetrical repulsion. In the case of asymmetrical arrangement of the separating plate with respect to the end faces, correspondingly asymmetrical repulsion forces, such as even tilting forces, for example, can be implemented.

Instead of a linear movement of the magnets toward one another or with respect to one another, other directions of movement of the magnets can also be brought about.

If, in an alternative embodiment of the invention, there is provision for the first switching device with the magnet to be arranged on a pivoting lever, one or both magnets can correspondingly pivot with respect to one another on a curved path or circular path. In this case, the contact bridge is arranged on the pivoting lever, while the magnet, which is arranged on the pivoting lever, describes a circular path.

In one arrangement of the switching apparatus device according to the invention in a vehicle, the two switching devices are generally mounted in a common housing which is installed in a fixed vehicle component, for example the vehicle bodywork, and in this context a driver element or an activation element which is arranged in the movable vehicle component, for example a door, correspondingly activates the movable switching element, for example a switching tappet.

In a further solution according to the invention in accordance with claim 15, magnetic attraction forces are used instead of the use of magnetic repulsion forces.

In this embodiment also, the first switched state occurs at a relatively precisely predefined switching point, while the second switched state occurs only after a predefined amount of play with separation of the two magnets which attract one another.

A very advantageous structural embodiment for this solution can take the form of one of the two switching device components being provided with a movable magnet carriage which has the at least one magnet or the magnetic contact component.

As a result of the fact that one of the two switching device components is provided with a movable magnet carriage for producing an electrical connection, it is possible, owing to the mobility of the magnet carriage, to maintain the electrical contact for even longer as desired even when there are relative movements or vibrations between the two elements, for example between a door and a vehicle frame, because, within its range of movement, the magnet carriage in the vehicle frame can correspondingly follow the movable part which is moving away, for example the door, before the contact is interrupted.

However, the inverted arrangement of the two switching device components is of course also possible, i.e. the switching device component is arranged with the magnet carriage in the movable component, for example the door.

So that switching points which are precise and always constant are obtained, it is possible to provide that in the contactless state of rest the magnet carriage bears against a restraining magnet or a magnetic restraining element.

A very advantageous structural embodiment can consist in the fact that the switching housing is provided with at least one stop which constitutes a travel limitation for the magnet carriage, wherein the position of the stop is selected such that contact takes place with the other switching device component after a distance X which corresponds to a distance between the movable magnet carriage and the restraining magnet or magnetic restraining element, wherein after the travel X there is still a distance Y between the magnet carriage and the stop, within which distance Y contact is maintained between the two switching device components.

Given a corresponding embodiment and position of the switching device component with the magnet carriage in the interior of the switching housing it is possible for the distance X and the distance Y to be added as overall travel as a maximum movement possibility for the magnet carriage and therefore in order to bring about the switched connection.

In order to compensate tolerances and possibly also bring about adaptation to different types of vehicle, it is advantageous if the distances X and Y are adjustable.

A very wide variety of structural measures, such as for example restraining magnets or magnetic restraining elements of different thicknesses for the distance X or adjustability of the at least one stop for the distance Y are possible to permit adjustments to be made. In the same way, the thickness of the wall or the thickness of the magnet carriage can also be correspondingly changed in the direction of movement.

In order to produce an electrical connection or a switched state signal between the two elements, it is possible to provide that a switching device component has at least two contact elements which are arranged at a distance from one another, wherein the other switching device component is provided with a contact bridge which, when contact is made between the two switching device components, short-circuits the at least two contact elements.

However, as an alternative to this, it is, of course, also possible to provide that a switching device component has at least two contact elements which, when contact is made with the other switching device component, makes contact with at least two corresponding contact elements.

BRIEF DESCRIPTION OF THE DRAWINGS

Exemplary embodiments of the invention will be described below in principle with reference to the drawing, in which.

DETAILED DESCRIPTION OF THE INVENTION

Figure 1:
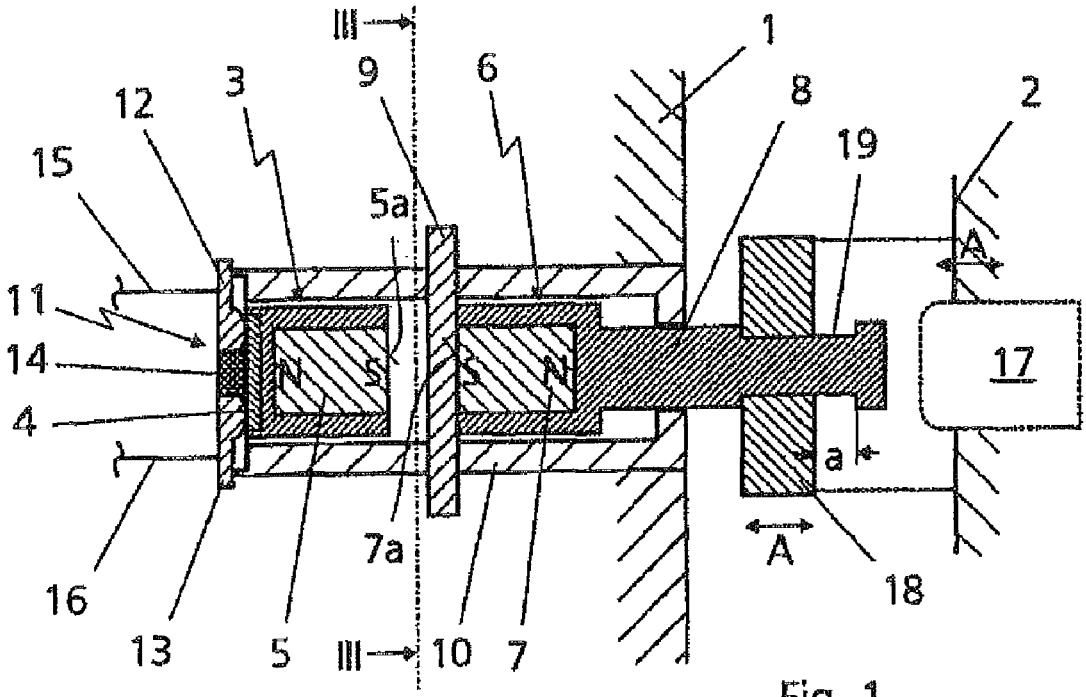
FIG. 1 shows a side view of the apparatus according to the invention in a closed-circuit state.

The apparatus according to the invention is described using an example for a vehicle wherein a component of the vehicle or of the vehicle frame 1 is intended to constitute as fixed element and a door, for example a sliding door 2, of the vehicle is intended to constitute as a movable element. However, of course, the apparatus according to the invention is also suitable for other elements in which relative movements or vibrations may occur between a first element and a second element, or there may be large tolerances present. Likewise, if appropriate both elements may also be movable with respect to one another.

Further application fields are, for example, machines, apparatuses and devices which are subject to strong vibrations or which are also arranged in mobile systems, machines and the like. Instead of being used to produce an electrical connection or a specific switched state, the apparatus according to the invention can, if necessary, also be used for mechanical switching operations. For example, in this way it is possible, inter alia, to perform mechanical locking operations, for example of doors or locks of cases.

The magnetic switching apparatus according to the invention for producing an electrical state or actuating a display has a first switching device 3, which has a contact bridge 4 and a displaceable magnet 5. The contact bridge 4 is arranged on a mount, which is not magnetic and not electrically conductive, on the side of the magnet 5 facing away from a second switching device 6. The second switching device 6 is also provided with a magnet 7. The magnet 7 with its mount, which is also not magnetic, is provided with a movable switching element in the form of a switching tappet 8. A separating plate 9 made of ferromagnetic material is positioned between the two magnets 5 and 7 whose polarity is arranged in such a way that the same polarity, in the present case a south pole, is provided on each of the end faces 5*a* and 7*a* facing one another.

The two magnets 5 and 7 have circular end faces 5*a* and 7*a*. The separating plate 9 is embodied as a rectangle, wherein the shorter side is narrower than the respective diameter of the end faces 5*a* and 7*a* of the magnets 5 and 7. From FIG. 3 it is clear that in this way two symmetrical circular face sections of the end faces 5*a* and 7*a* are not covered in each case.

The two switching devices 3 and 6 and the separating plate 9 are arranged together in a housing 10. The switching tappet 8 projects with its free end out of an end-side opening of the housing 10. On the opposite side of the housing 10, a contact element 11 is arranged which is provided with connecting contacts 12 and 13 and an insulating component 14, for example made of plastic, located between them. Contact lines 15 and 16 branch off (in a way not illustrated in more detail) from the connecting contacts 12 and 13. The contact bridge 4 is arranged on the side facing away from the end face 5*a*. If the linearly movable magnet 5 is located in its pushed-back position facing away from the other magnet 7, according to FIG. 1 the contact bridge 4 bears against the contact element 11, wherein the insulating component 14 is bridged and in this way an electrical contact is produced with the connecting contacts 12 and 13. This means, in this state which is referred to as the first switching state, an electrical connection is provided between the lines 15 and 16. In this way, an electrical connection is produced to a load, for example a lighting device, or an electrical control pulse.

The position of the contact bridge 4 on the contact element 11 was brought about due to the positioning of the magnet 7 with direct abutment against the separating plate 9 due to the magnetic repulsion forces. The abutment of the magnet 7 against the separating plate 9 is brought about by means of an activation element which pushes the switching tappet 8 in a correspondingly linear fashion in the direction of the arrow A. The activation element can be a simple driver element in the form of a switching pin 17 (dashed illustration in FIG. 1) which is arranged in the door 2 in the exemplary embodiment. The switching pin 17 activates, through its linear movement, the switching tappet 8. When there is a movement in the direction of the arrow (to the left in the exemplary embodiment) the magnet 7 comes to bear against the separating plate 9, in which case, as it approaches, the magnet 5 is simultaneously correspondingly repelled by the magnetic force due to the same polarity at the end faces facing one another, and it therefore comes to bear with its contact bridge 4 against the contact element 11. This switched state is brought about in a very defined and precise fashion when the switching pin 17 is activated.

The switched state illustrated in FIG. 1 is intended to be reliably maintained even if displacements in or on the vehicle or in or on the door 2 occur owing to tolerances, vibrations or other movements. If displacements or brief detachment of the magnet 7 from the separating plate 9 occur due to these movements, the magnet 5 nevertheless remains in abutment with its contact bridge 4 against the contact element 11.

The magnet 5 is not attracted by the ferromagnetic separating plate 9 again until the magnet 7 is selectively moved again to the right in the drawing, which can be carried out by means of a spring (not illustrated) or else by means of the activation element 17 (dashed illustration) or some other restraining element, and the magnetic repulsion forces become weaker than the forces retaining the magnet 5 on the contact element 11, and this attraction of the magnet 5 by the ferromagnetic separating plate 9 causes the contact connection between the lines 15 and 16 to be disconnected. In this way, an open position of the contact connection is brought about as a second switched state.

However, this second switched state is not brought about immediately after the magnet 7 becomes detached from the separating plate 9 but rather only after an amount of movement play which is selected through interaction between the position of the ferromagnetic separating plate 9, of the contact element 11, of the two magnets 5 and 7 and of its magnetic forces, such that it is ensured that no unintended switched states are brought about, for example when vibrations occur.

Instead of a switching pin 17, a switching fork 18 can also be provided as the activation element, said switching fork 18 being guided in a circumferential cutout 19 in the switching tappet 8 and in this way acting as a driver element. If the switching fork 18, which is also arranged in, or connected to, the component 2, which can be a door, a tailgate or a similar movable component (illustrated by dashed lines), is pushed in the direction of the arrow A, the switching tappet 8 is also moved.

In this context it is possible to provide that the width of the switching fork 18 is smaller than the cutout 19 in the longitudinal direction or in the direction of movement. In this way, an amount of play a (see FIG. 1) remains. As a result of the amount of play a, reversal play can occur between the two linear movements of the switching tappet 8 which are directed in opposition to one another.

The arrangement of the entire switching apparatus in a common housing 10 also provides, in addition to simplified mounting, the further advantage that the components of the switching apparatus are very largely protected against environmental influences, since they are located in the interior of a housing. Only the switching element, for example in the form of a switching tappet, projects out of the housing 10. If the switching tappet 8 is embodied with a circular cross section, a very simple seal can be brought about here.

Figure 2:
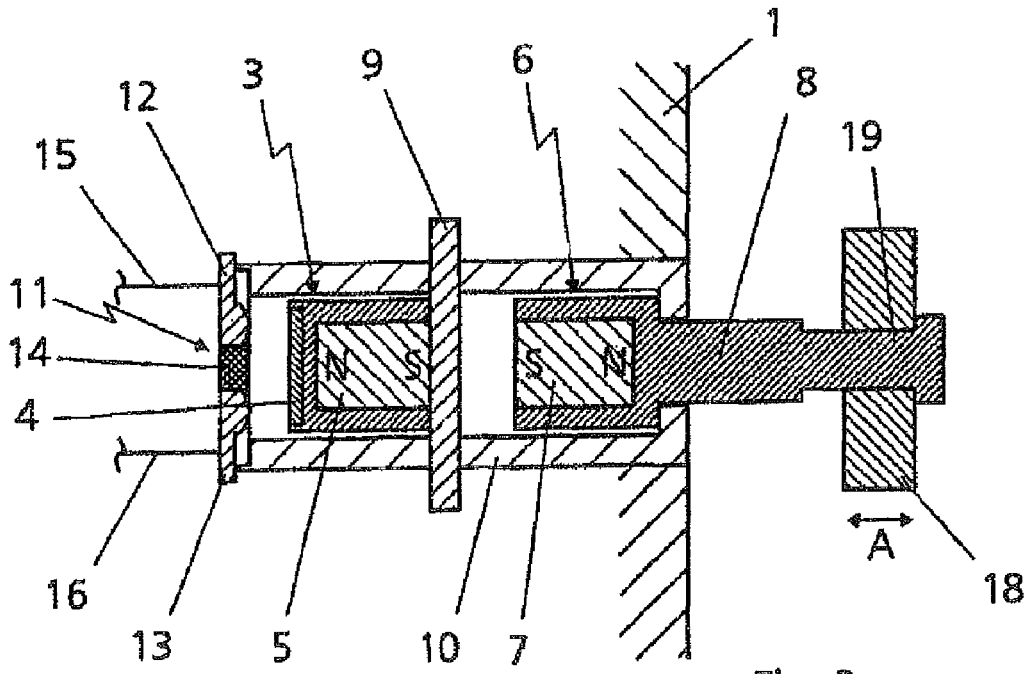
FIG. 2 shows the switching apparatus according to FIG. 1 in the opened switching state.
Figure 3:
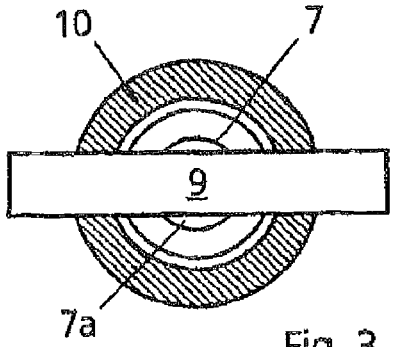
FIG. 3 shows an enlarged illustration in a section along the line in FIG. 1.
Figure 4:
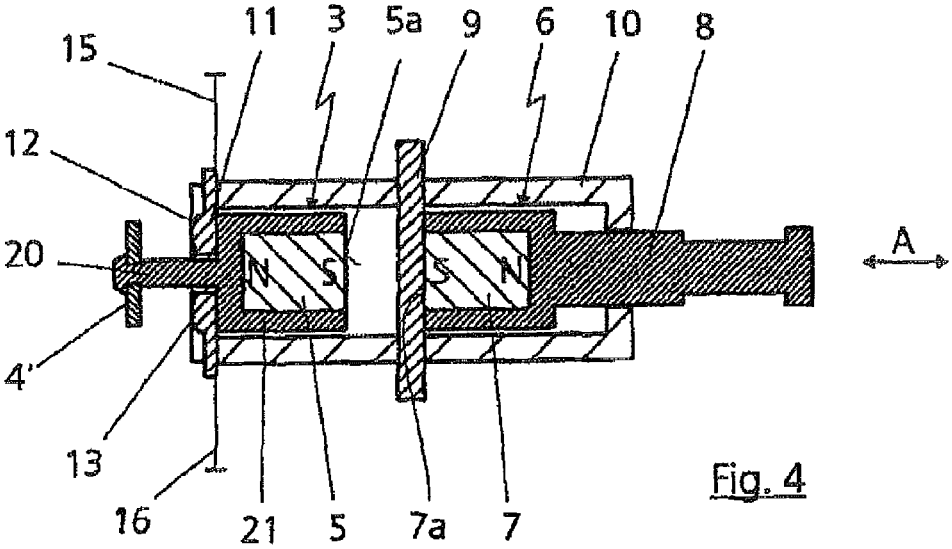
FIG. 4 shows the exemplary embodiment according to FIGS. 1 and 2 with inverted switching states.
Figure 5:
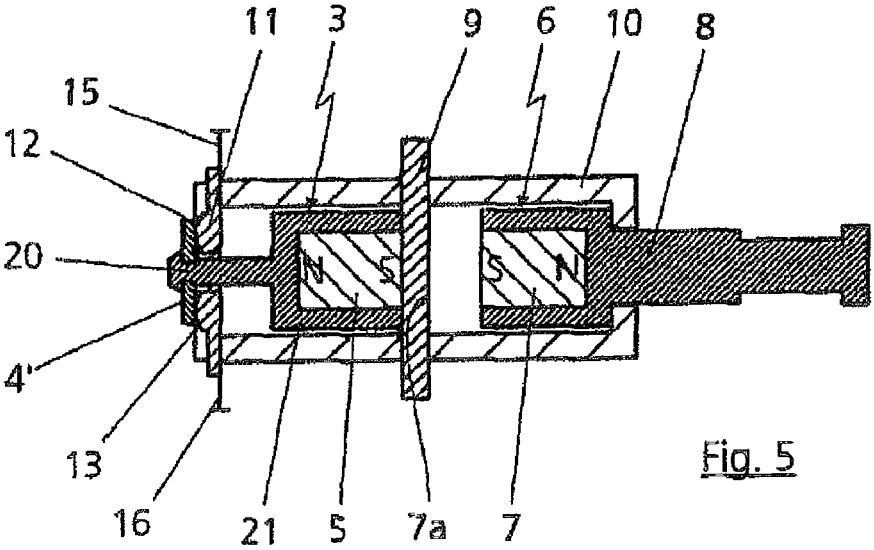
FIG. 5 shows the exemplary embodiment according to FIGS. 1 and 2 with inverted switching states.

FIGS. 4 and 5 basically illustrate the same embodiment of a switching apparatus as in FIGS. 1 to 3. Only the switched states are different. For this reason, the same reference symbols have also been retained for the identical components. The only difference in structural terms is that instead of an arrangement of the contact bridge 4 on the mount 21 directly behind the magnet 5, a contact bridge 4' is arranged on the mount 21 at a distance from the rear side of the magnet 5 by means of an extension element 20. The connecting elements 12 and 13 of the contact element 11 are arranged here on the side facing away from the magnet 5, while in the exemplary embodiment according to FIGS. 1 and 2 they are mounted on the side facing the magnet 5.

According to FIG. 4, the magnet 7 bears against the separating plate 9, for which reason the magnet 5 is in the pushed-back state, as a result of which in the first switched state no electrical connection is present between the lines 15 and 16. This state is brought about very precisely. However, the second switched state, as illustrated in FIG. 5, is not already brought about due to vibrations or similar slight displacements but rather is not brought about until after a preselected amount of play with a corresponding movement of the switching tappet 8 away from the separating plate 9. This direction of movement, which is brought about by the displacement of the switching tappet 8 (to the right in the drawing) can take place, for example, as a result of a tappet movement when the door 2 or a tailgate opens. Due to the flow of current which is brought about between the lines 15 and 16 in this context, it is then possible, for example, to activate a light.

Figure 6:
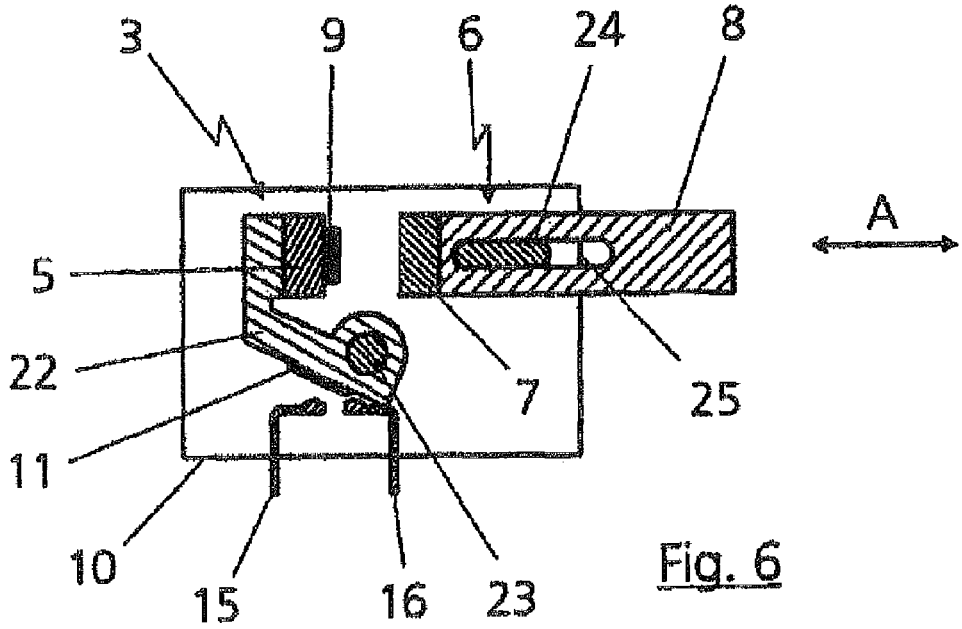
FIG. 6 shows a further exemplary embodiment of the apparatus according to the invention in a side view with a pivoting lever with the normally open contact opened.
Figure 7:
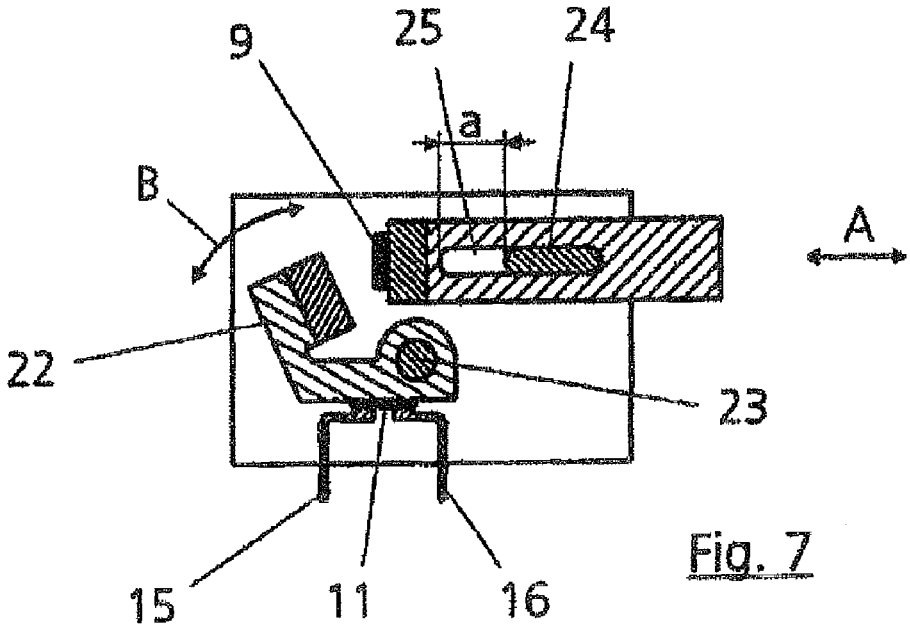
FIG. 7 shows the exemplary embodiment according to FIG. 6 with the normally opened contact closed.

FIGS. 6 and 7 illustrate an embodiment in which the switching device 3 is arranged with the magnet 5 on a pivoting lever 22. The pivoting lever 22 has a bearing axle 23 about which it can pivot, in which case the switching device 3 with the magnet 5 also carries out a pivoting movement. The pivoting radius is dependent here on the distance between the switching device 3 and the pivoting axis 23. In this exemplary embodiment it is also possible to arrange the entire switching apparatus in a common housing 10. In the illustration in FIG. 6, there is no connection to the lines 15 and 16 because the magnet 5 bears against the separating plate 9. As is apparent, the switching tappet 8, on whose front end the switching device 6 with the magnet 7 is arranged, can be moved by means of a switching pin 24 in the direction of the arrow A which is accommodated and guided in a cutout 25 in the switching tappet 8.

FIG. 7 shows the positions of the switching devices 3 and 6 in which a flow of current flows through the lines 15 and 16. As is apparent, in this context the switching tappet 8 is located in its front position in abutment against the separating plate 9. For this reason, as a result of the magnetic repulsion forces the magnet 5 of the switching device 3 is pushed away on a circular-arc-shaped path B from the separating plate 9 when the magnet 7 approaches the separating plate 9, as a result of which the contact bridge 11 which is arranged on the side of the pivoting lever 22 facing away from the switching device 6 produces an electrical connection between the lines 15 and 16.

Depending on the switched states which are desired, the contact bridge 11 can, however, also be arranged on the side of the pivoting lever 22 which faces the switching device 6.

The embodiment with the pivoting lever 22 has the advantage that due to the distance between the contact bridge 11 and the pivoting axis 23, the lever force of the pivoting lever 22 produces very good contact engagement between the contact bridge 11 and the lines 15 and 16.

In the exemplary embodiment according to FIGS. 6 and 7, the closing contact via the contact bridge 11 is illustrated only symbolically, but, of course, other embodiment variants are also possible here, for example rotations through 90°, movement of a lug by a cam and the like.

As is apparent from FIGS. 6 and 7, an amount of reversal play a is also present here.

All that is significant is that the inventive use of magnetic repulsion forces in conjunction with the switching devices 3 and 6 permits switched states of any desired type to be produced, which, depending on the positioning of the magnets 5 and 7, a precise switched position for a switched state and for a reversal position for another switched state the latter is only brought about after a predefined amount of play.

Figure 8:
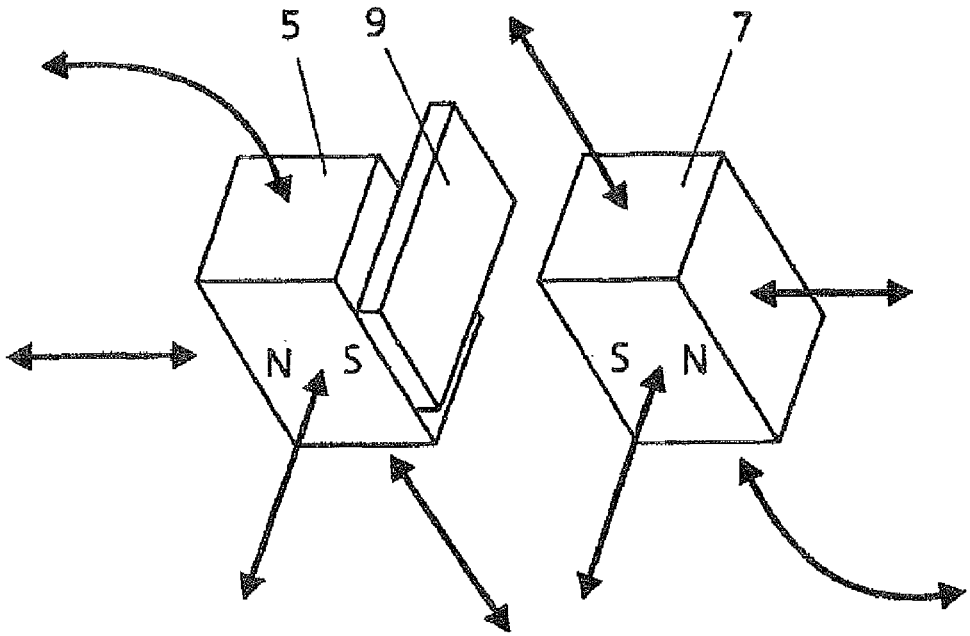
FIG. 8 shows a basic illustration of various triggering movements.

FIG. 8 shows in a basic illustration that a wide variety of triggering movements of the magnet 5, acting as a switching magnet, of the first switching device 3 is possible by virtue of different actuation directions of the magnet 7, acting as an activation magnet, of the second switching device 6.

As is illustrated by the arrows, for example radial and transversal directions of movement are possible in each axis. The basic principle is always the same. By moving the magnet 7 closer to the separating plate 9—from any direction—the magnet 5 is moved away from the separating plate 9 by the magnetic repulsion forces, in which case, depending on the type of bearing of the magnet 5 with the switching tappet 8, a wide variety of directions of movement are also possible.

Figure 9:
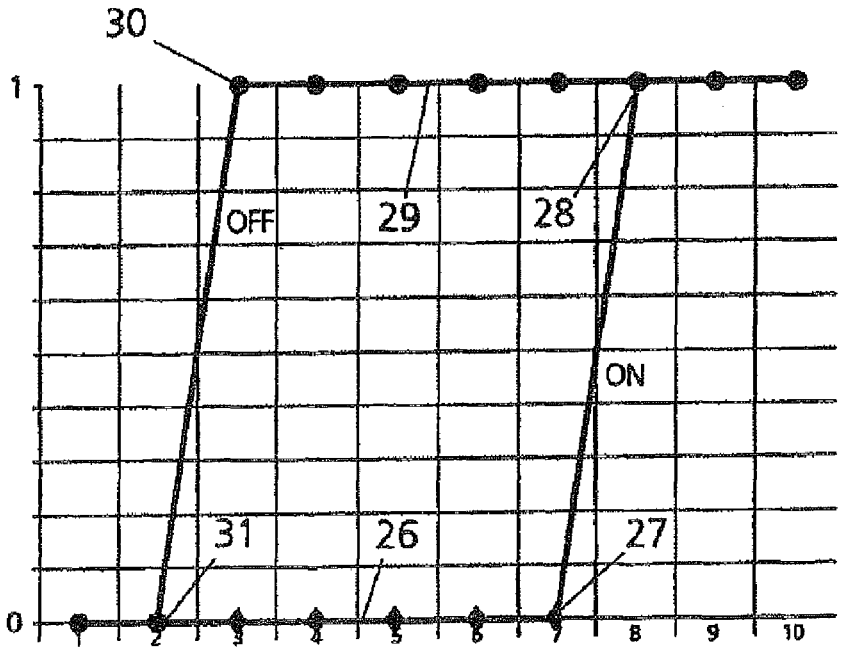
FIG. 9 shows a hysteresis diagram.

FIG. 9 shows a hysteresis diagram relating to the different switching-on and switching-off points of the switching apparatus according to the invention. The travel of the switching devices 3 and 6 is given as units on the abscissa of the diagram, for example mm travel. The switched state is illustrated on the ordinate.

The travel of the magnet 7 of the switching device 6 starting from the point 31 via point 27 as far as the switching point 28 is illustrated as an example. As is apparent, the switching is initiated by repulsion of the magnet 5 from the separating plate 9 only after a specific, previously defined or set travel length starting from point 27. The approach travel of the magnet 7 to the separating plate 9 is denoted in the diagram by "26" between the points 31 and 27.

A "reverse travel", which is located with the reference symbol "29" between the switching point 28 and the switching point 30, is the travel in which no switching is produced despite movement of the magnet 7, for example due to vibrations. Switching, which is switching off in the present case, does not occur until the switching point 30.

Moreover, of course, reversed switching points are also possible, with switching off occurring on the travel from point 31 via point 27 to the switching point 28, and switching on or activation of the switching apparatus subsequently occurring at the switching point 30.

In the exemplary embodiment according to FIGS. 10 to 13, magnetic attraction forces for the desired switching states, which occur in different ways, are illustrated in the form of kinematic reversal.

Figure 10:
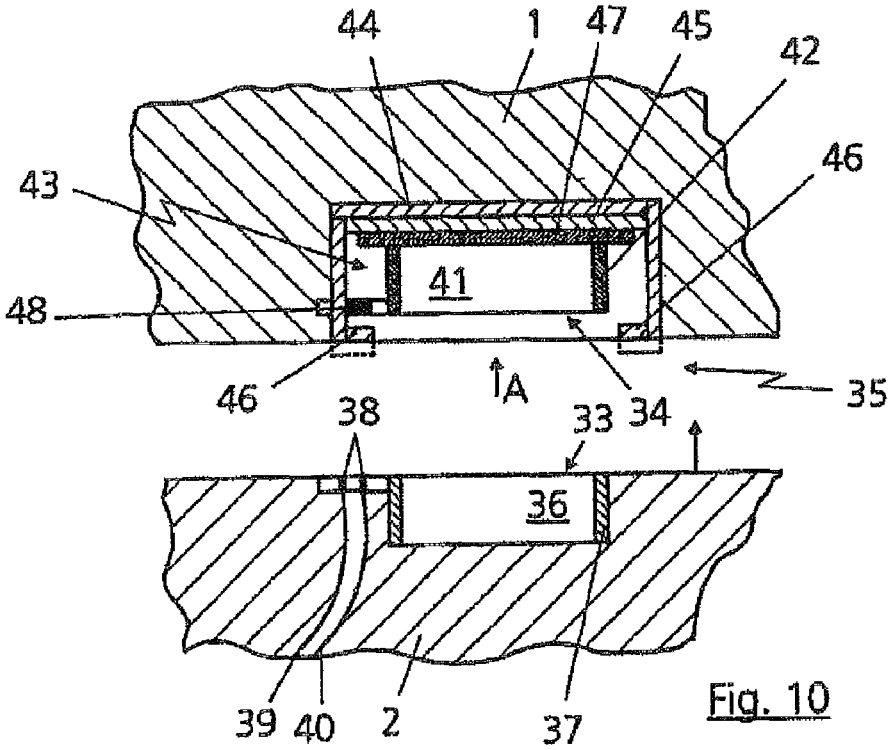
FIG. 10 shows a side view of a further embodiment of the apparatus according to the invention, with a moving element being moved closer to a fixed element.

According to FIG. 10, a first switching device component 33 is arranged in the door 2, which switching device component 33 constitutes, together with a second switching device component 34, a switching device 35 which can produce an electrical connection between the vehicle frame 1 and the door 2, or at which switching device 35 an open state or a specific switching state is displayed or monitored by means of the connection of the electrical lines.

The switching device component 33 has one or more magnets 36 which are arranged in a plastic housing 37. One or more contact elements 38, which are connected to electrical feed lines 39 and 40, are arranged on the plastic housing 37.

The switching device component 34 also has one or more magnets 41 which are also arranged in a plastic housing 42. In contrast to the magnet 37, arranged in the plastic housing 37, of the switching device component 33, the plastic housing 42 and the magnets 41, which are embodied with opposed poles to the magnets 36, form what is referred to as a magnet carriage 43. The magnet carriage 43 is arranged so as to be displaceable in a non-magnetic switching housing 44 in the axial direction or in the direction of the approaching movable element 2, namely the door.

On the side facing away from the door 2, a soft iron plate 45 is located as a magnetic retaining element in the switching housing. On the side facing the door 2, the switching housing 44 is provided with one or more stops 46, against which a stop element 47, arranged on the magnet carriage 43, comes to bear when the magnet carriage 43 is fully extended (see FIG. 12). The stop element 47 can be, for example, a plate which protrudes beyond the circumference of the magnet carriage 43 and which is arranged on the rear side of the magnet carriage 43, or forms part of the rear side of the magnet carriage 43 with correspondingly protruding parts.

The stop or stops 46 on the switching housing 44 can, for example, be one or more inwardly extending indents, cams or strips against which the stop element 47 comes to bear.

The magnet carriage 43 is provided with one or more contact bridges 48 which, when contact is made between the two switching device components 33 and 34 for a switched state, produces a short-circuit connection between the two connecting lines 39 and 40 via the contact elements 38.

Of course, a contact bridge 48 is not absolutely necessary for producing an electrical connection.

Figure 13:
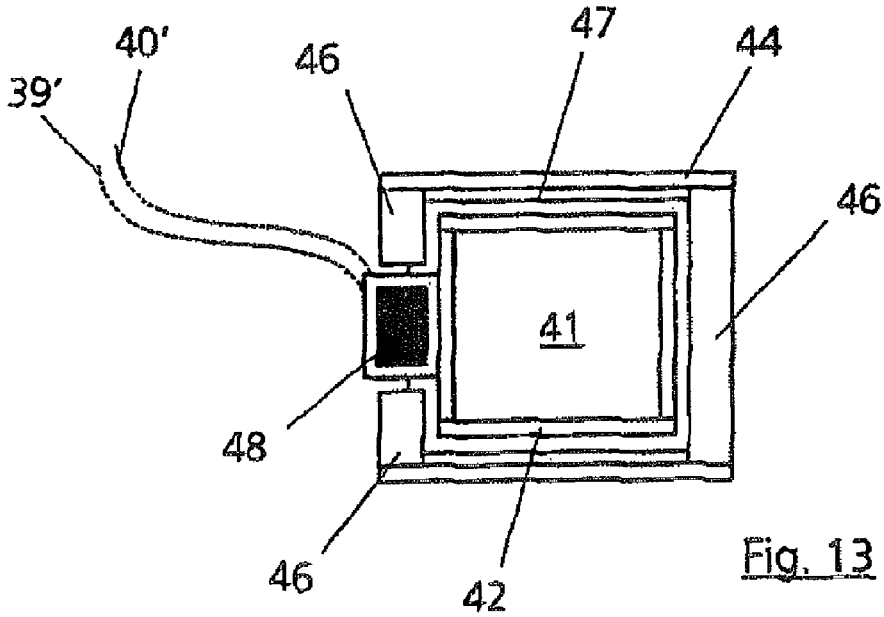
FIG. 13 shows a plan view of a switching device component with a magnet carriage from the direction of the arrow A in FIG. 10.

Corresponding contacts for the connecting lines 39 and 40, ending in the contact components 38, can also be provided for a current-conducting or signal-conducting connection between the vehicle frame 1 and the door 2, via which corresponding contacts further transmission can occur via electrical connecting lines 39', 40' into the vehicle frame, or vice versa (see dashed illustration in FIG. 13).

Figure 11:
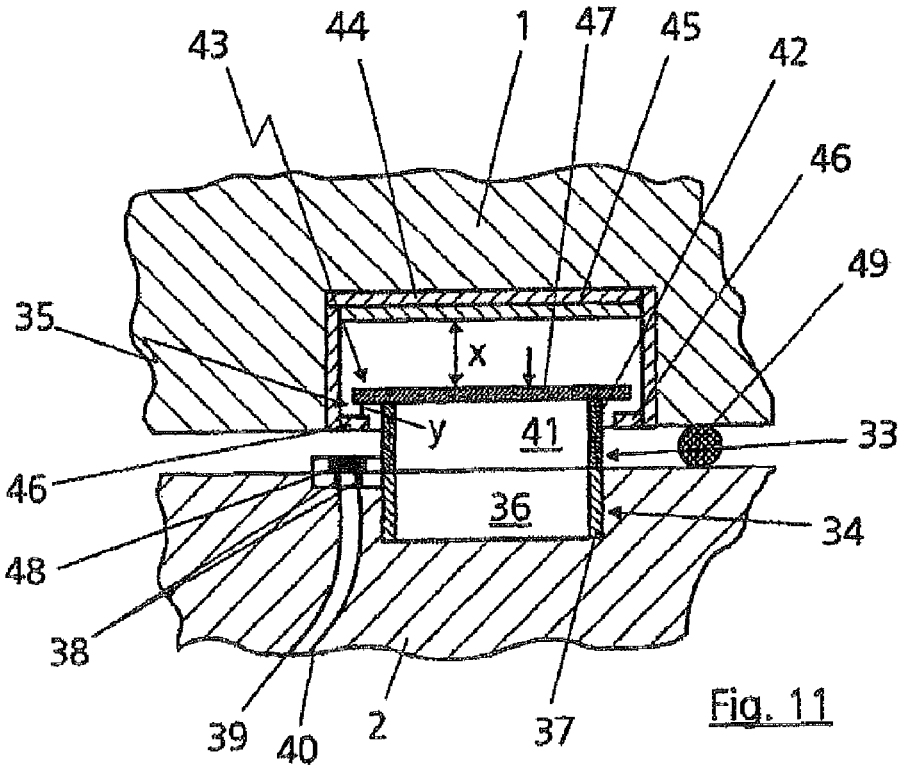
FIG. 11 shows the electrical connecting apparatus according to FIG. 10 with the two switching device components in a closed state.
Figure 12:
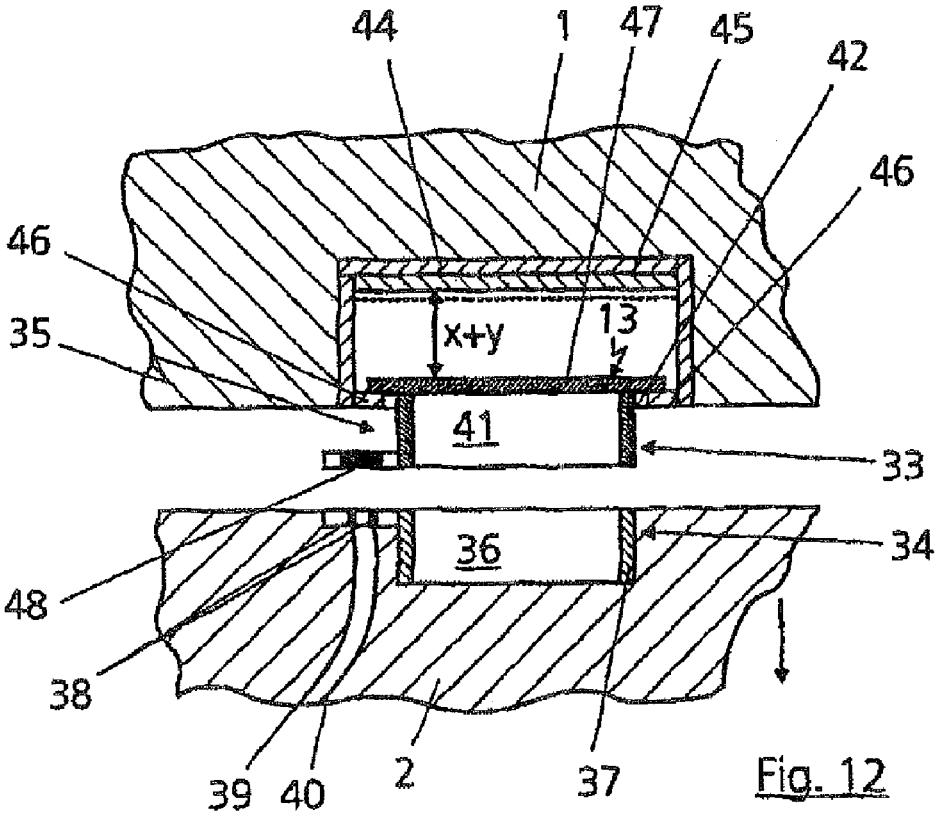
FIG. 12 shows the electrical connecting apparatus according to FIGS. 10 and 11 in the state in which the movable element is moved away from the fixed element again.

FIGS. 11 and 12 show how the electrical switching connection functions, in particular in what way different switching-on and switching-off positions are brought about.

As soon as, as a result of closing the door 2, the first switching device component 33 approaches the second switching device component 34 and the attraction force of the magnets 36 and 41 is effective, the magnet carriage 43 becomes detached from the soft iron plate 45, and the contact component with the contacts 38 makes contact with the contact bridge 48. Of course, the magnetic forces must be selected such that the magnetic attraction force between the magnets 36 and 41 is greater than the magnetic retaining force as a result of the soft iron plate 45.

As is apparent from FIG. 11 electrical contact takes place between the contact component 38 and the contact bridge 48 after a distance or travel X, which corresponds to a distance between the movable magnet carriage 43 and the soft iron plate 45 as the retaining element. However, at the same time there is still a travel or distance Y present between the stop element 47 and the stop 46.

Only when the distance Y becomes zero and the door 2 is opened further, is the magnet carriage 43 retained by the stop element 47 on the stop 46, and it can therefore no longer follow the switching device component 33, which, of course, is arranged on the opening door 2 (see FIG. 12). This means that when the door 2 is actually opened, the electrical connection is disconnected.

However, since according to FIG. 11 the electrical connection has occurred after the travel X and the electrical connection is also maintained in the movement range of the magnet carriage 43 within the distance Y, this means that relative movements of this order of magnitude can occur between the vehicle frame 1 and the door 2. These relative movements are present because one or more elastic seals 49 (see FIG. 11) are located between the door 2 and the vehicle frame 1. However, since the magnet carriage 43 can also still move back, in which case the distance X is reduced when the door 2 moves even closer to the vehicle frame 1, in this case an electrical connection is maintained because the magnetic attraction forces of the magnets 36 and 41 are greater than the magnetic attraction force toward the soft iron plate 45. The only precondition for this is that the position of the switching device component 33 with the contact component 38 is selected such that there is still a distance from the front end of the switching housing 44, which distance would therefore correspond at most to the distance X.

In this way, relative movements can occur of an overall order of magnitude X+Y between the vehicle frame 1 and the door 2 before the electrical connection is disconnected.

The travel X can be changed by means of different thicknesses of soft iron plates 45, which are exchanged correspondingly when required. This is illustrated by dashed lines in FIG. 12.

The same applies to the travel Y, which can also be changed by adjustment or by means of different thicknesses of the stop 46 (illustrated in dashed lines) or by positioning the stop component 47 differently, as is indicated in FIG. 10.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. A magnetic switching apparatus, comprising:

a first switching device and a second switching device, said first switching device including a movable first magnet connected to a contact bridge, said second switching device including a second magnet which is connected to a movable switching element which is embodied as a switching tappet, said first magnet and said second magnet having respective end faces that face one another and have the same polarity, and wherein a separating plate made of ferromagnetic material, which is smaller than said end faces, is positioned between said first magnet and said second magnet, and wherein said movable first magnet and said separating plate are separable from one another by a distance which is adjustable, said first switching device and said second switching device being arranged in a housing from which said switching element projects, said housing having a side facing away from said first switching device, said switching element projecting from said side of said housing, said switching tappet being provided with a driver element which an activation element engages with play.

2. A magnetic switching apparatus as claimed in claim 1, wherein said contact bridge is arranged on a side of said first switching device which faces away from said second switching device and wherein said contact bridge is mounted for connection to a contact element which includes electrical contacts.

3. A magnetic switching apparatus as claimed in claim 1, wherein said end faces are at least approximately circular in shape.

4. A magnetic switching apparatus as claimed in claim 1, wherein said end faces are square or rectangular in shape.

5. A magnetic switching apparatus as claimed in claim 4, wherein said separating plate is circular, square or rectangular, wherein the diameter or length of at least one side of said separating plate is less than the, or length of at least one side of said end faces.

6. A magnetic switching apparatus as claimed in claim 1, wherein said separating plate is of circular, square or rectangular shape wherein a diameter, or length of at least one side, of said separating plate is less than a diameter, or length of at least one side, of said end faces of.

7. A magnetic switching apparatus as claimed in claim 1, wherein said first switching device and said second switching device are used in a vehicle, and wherein said movable switching element is activated by a said activation element which is mounted to the vehicle.

8. A magnetic switching apparatus as claimed in claim 7, wherein said activation element is mounted to a door, a tailgate or an engine hood of the vehicle.

9. A magnetic switching apparatus, comprising:

a housing, a first switching device arranged in said housing and a second switching device arranged in said housing, said first switching device including a movable first magnet connected to a contact bridge, said second switching device including a second magnet which is connected to a movable switching element which projects from a side of said housing facing away from said first switching device, said switching element being embodied as a switching tappet which is provided with a driver element on which an activation element engages with play, said first magnet and said second magnet having respective end faces that face one another, said end faces each having the same polarity, and wherein a separating plate made of ferromagnetic material, which is smaller than said end faces, is positioned between said first magnet and said second magnet.

10. A magnetic switching apparatus as claimed in claim 9, wherein said movable first magnet and said separating plate are separable from one another by a distance which is adjustable.

11. A magnetic switching apparatus as claimed in claim 9, wherein said contact bridge is arranged on a side of said first switching device which faces away from said second switching device and is mounted for connection to a contact element which is provided with connecting contacts.

12. A magnetic switching apparatus as claimed in claim 9, wherein said end faces are at least approximately circular in shape.

13. A magnetic switching apparatus as claimed in claim 12, wherein the separating plate is circular, square or rectangular and wherein a diameter, or length of at least one side, of said separating plate is smaller than a diameter, or length of at least one side, of said end faces.

14. A magnetic switching apparatus as claimed in claim 9, wherein said end faces are square or rectangular in shape.

15. A magnetic switching apparatus as claimed in claim 14, wherein said separating plate is circular, square or rectangular, wherein a diameter or length of at least one side of said separating plate is smaller than a diameter or length of at least one side of said end faces.

16. A magnetic switching apparatus as claimed in claim 9, wherein said movable first switching element is activated by an activation element mounted to a movable component of a vehicle in which the magnetic switching apparatus is used.

17. A magnetic switching apparatus, comprising:

a first switching device and a second switching device, said first switching device including a movable first magnet connected to a contact bridge, said second switching device including a second magnet which is connected to a movable switching element, said first magnet and said second magnet having respective end faces that face one another and have the same polarity, and wherein a separating plate made of ferromagnetic material, which is smaller than said end faces, is positioned between said first magnet and said second magnet, and wherein said movable first magnet and said separating plate are separable from one another by a distance which is adjustable, said first switching device and said second switching device being arranged in a housing from which said switching element projects, said housing having a side facing away from said first switching device, said switching element projecting from said side of said housing, said switching element being provided with a driver element which an activation element engages with play.

18. A magnetic switching apparatus comprising:

a pair of electrical contacts;

a first switching device including a movable first magnet and a contact bridge to which said first magnet is connected;

a second switching device including a second magnet;

a housing in which said first switching device and said second switching device are located, said housing having a side facing away from the first switching device;

a movable switching element connected to said second magnet and projecting from said housing; and a separating plate of ferromagnetic material located between said first magnet and said second magnet, said first magnet and said separating plate being separable from one another by a distance which is adjustable; said first magnet and said second magnet having respective end faces that face toward one another and have the same polarity; said separating plate being of a smaller dimension than said end faces; said switching element being provided with a driver element which engages an activation element with play.

19. A magnetic switching apparatus, comprising:

a contact element having a pair of electrical contacts;

a first switching device including a movable first magnet and a contact bridge to which said first magnet is connected, said contact bridge being movable with said first magnet to effect either a first switched state in which said pair of contacts are electrically connected to one another by way of said contact bridge or a second switched state in which said pair of contacts are not electrically connected to one another by way of said contact bridge;

a second switching device including a second magnet;

a housing in which said first switching device and said second switching device are located, said housing having a side facing away from the first switching device;

a movable switching element connected to said second magnet and projecting from said housing; and a separating plate of ferromagnetic material located between said first magnet and said second magnet;

said first magnet and said second magnet having respective end faces that face one another and have the same polarity; said separating plate being of a smaller a dimension than said end faces; said first magnet and said separating plate being separable from one another by a distance which is adjustable; said switching element being provided with a driver element which engages an activation element with play.

20. A magnetic switching apparatus actuatable by an activation element, said magnetic switching apparatus comprising:

a contact element having a pair of electrical contacts;

a first switching device including a movable first magnet and a contact bridge to which said first magnet is connected;

a second switching device including a second magnet;

a housing in which said first switching device and said second switching device are located, said housing having a side facing away from the first switching device;

a movable switching element connected to said second magnet and projecting from said housing; and a separating plate of ferromagnetic material located between said first magnet and said second magnet, said first magnet and said separating plate being separable from one another by a distance which is adjustable;

said first magnet and said second magnet having respective end faces that face toward one another and have the same polarity; said separating plate having a dimension which is smaller than said end faces of said magnets; said switching element being provided with a driver element which engages the activation element with play.

21. A magnetic switching apparatus as claimed in claim 20, wherein said contact bridge and said first magnet are bidirectionally movable in response to engagement of the activation element with said driver element to effect either (i) a first switched state, in which said contact bridge provides an electrical connection between said pair of contacts in response to said switching element being driven in a first direction by the activation element to move said second magnet to repel said first magnet away from said separating plate, or (ii) a second switched state, in which said contact bridge does not electrically connect said pair of contacts to one another, in response to said switching element being driven in a second direction by the activation element to move said second magnet away from said separating plate thereby moving said first magnet and said contact bridge toward said separating plate and away from said contacts to break said electrical connection between said contacts.

* * * * *